US006196447B1

(12) United States Patent
Purcell et al.

(10) Patent No.: US 6,196,447 B1
(45) Date of Patent: Mar. 6, 2001

(54) ENVELOPE WITH OUTSIDE COUPON FLAP

(75) Inventors: Douglas K. Purcell, Chicopee, MA (US); Brian K. Dudley, Enfield, CT (US)

(73) Assignee: Westvaco Corporation, New York, NY (US)

( * ) Notice: Subject to any disclaimer, the term of this patent is extended or adjusted under 35 U.S.C. 154(b) by 0 days.

(21) Appl. No.: 09/550,235

(22) Filed: Apr. 14, 2000

(51) Int. Cl.[7] ..... B65D 27/00
(52) U.S. Cl. ..... 229/70; 462/65
(58) Field of Search ..... 229/68.1, 70; 462/64, 462/65

(56) References Cited

U.S. PATENT DOCUMENTS 1,171,703 * 2/1916 Cather ..... 229/70
2,112,227 * 3/1938 Berkowitz ..... 229/70
3,356,285 12/1967 Greason ..... 229/70
3,863,835 * 2/1975 Gendron ..... 229/70
4,047,661 * 9/1977 Klein ..... 229/70
5,025,980 * 6/1991 Blackman ..... 229/70
5,687,904 * 11/1997 Potter ..... 229/70

* cited by examiner

*Primary Examiner*—Stephen P. Garbe

(57) ABSTRACT

An envelope for first mailing having a closure flap and an outside bangtail flap which includes a detachable coupon portion. The bangtail flap is larger than the closure flap, is foldably attached to the rear panel of the envelope, and is adhered exteriorly thereto at its side edges, while the closure flap is foldably attached to the front panel of the envelope and is folded over about the bangtail flap and adhered thereto to close the envelope.

4 Claims, 3 Drawing Sheets

ENVELOPE WITH OUTSIDE COUPON FLAP

BACKGROUND OF INVENTION

The present invention relates to a style of envelope known as a bangtail envelope. Bangtail envelopes are known in the art as shown for example in U.S. Pat. No. 3,356,285. Essentially, a bangtail flap is an extra flap included on a conventional envelope structure that may be folded outside, as shown in the aforementioned patent, or tucked inside the envelope as shown for example in pending U.S. application Ser. No. 09/324,594, filed Jun. 3, 1999, and entitled "Easy Open Envelope", assigned to the present assignee herein.

Bangtail flaps are generally employed as a part of a return envelope that may be included in a first mailed envelope for commercial activities such as the payment of bills, the ordering of merchandise or the like. For this use, the bangtail flap is generally sized to be larger than the closure flap, and may take the form of a return slip, coupon, or detachable order form, or it may simply be used as an advertising or promotion attachment to the return envelope. When so used, the bangtail flap may be loosely associated with the return envelope since it is located in an enclosed environment during the initial mailing. Upon receipt, the recipient may detach the bangtail flap and discard it, or use it as a part of the materials included in the return envelope.

Meanwhile in U.S. Pat. No. 3,356,285, a bangtail flap is employed on an envelope used for first mailing. For this use the bangtail flap is sized so as to be smaller than the closure flap for the envelope so that it is essentially fully covered for first mailing. Under these conditions the bangtail flap is still detachable but it does not interfere with the automated machinery used to fill, close, and process envelopes, since it is covered by a large closure flap. Accordingly, it may be seen that while the prior art discloses bangtail envelopes useful for specific purposes, there remains a need in the art to provide such an envelope for first mailing where the bangtail flap includes an external detachable coupon that may be accessed without opening the envelope.

SUMMARY OF INVENTION

In accordance with the present invention, an envelope structure including an exterior bangtail flap which incorporates a detachable coupon is provided which includes a front panel, rear panel and a pair of side closure flaps connected together to define an envelope body with an open throat area. The envelope structure further includes an inner or bangtail flap foldably connected to the rear panel, and an outer closure flap foldably attached to the front panel. In use, the bangtail flap bearing the coupon is folded over to lie exteriorly of the rear panel, and the side edges thereof are adhered to the side edges of the rear panel or directly to the side closure flaps, as desired, so as to retain the coupon bearing bangtail flap in place during mailing. Meanwhile, the detachable coupon element is formed in the bangtail flap by perforated lines to permit easy removal thereof without opening the envelope.

It is therefore, an object of the present invention to provide a mailing envelope which, besides performing its usual function of carrying materials for the addressee, also provides additional functions such as for advertising and promotion of goods and services.

It is a further object of the invention to provide, in such an envelope, a return portion, coupon or detachable order form located on the exterior of the envelope which is detachable from the envelope without opening the envelope.

It is a further object of the invention to provide a mailing envelope of the type described which can be employed with conventional envelope handling and sorting equipment.

Further objects and features of the invention may be ascertained from a review of the detailed description and appended drawings included herewith.

DETAILED DESCRIPTION

Figure 1:
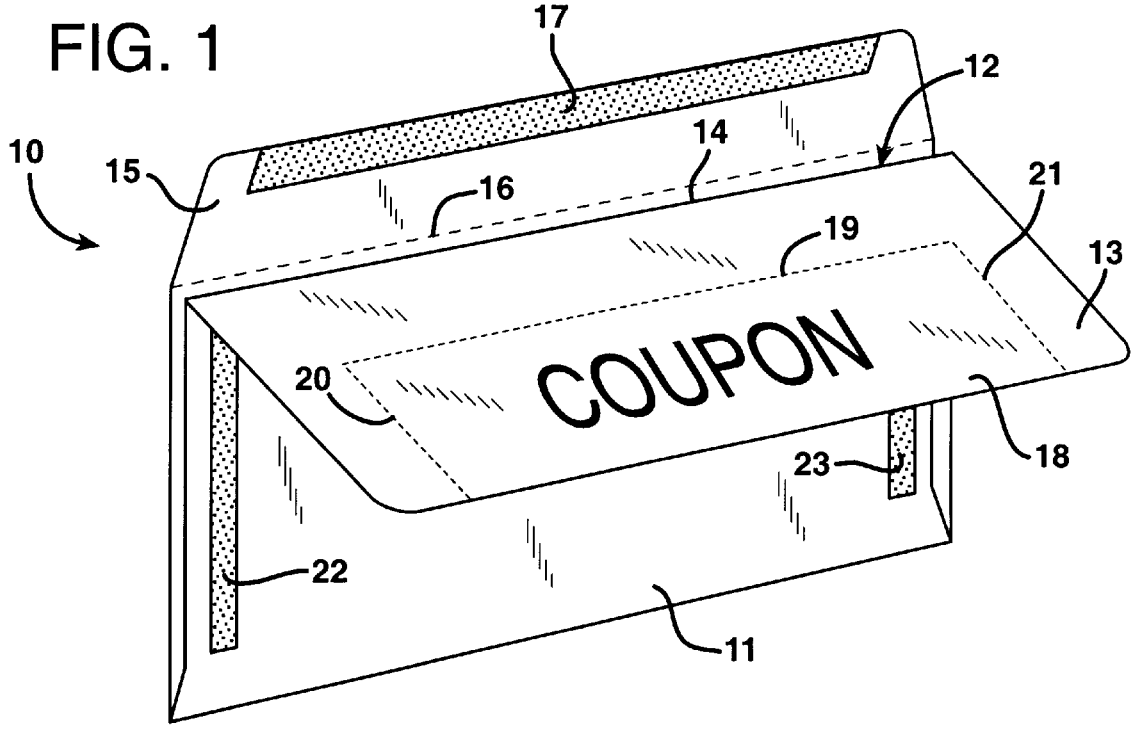
FIG. 1 is a perspective view showing one embodiment of an outside bangtail envelope according to the present invention.
Figure 2:
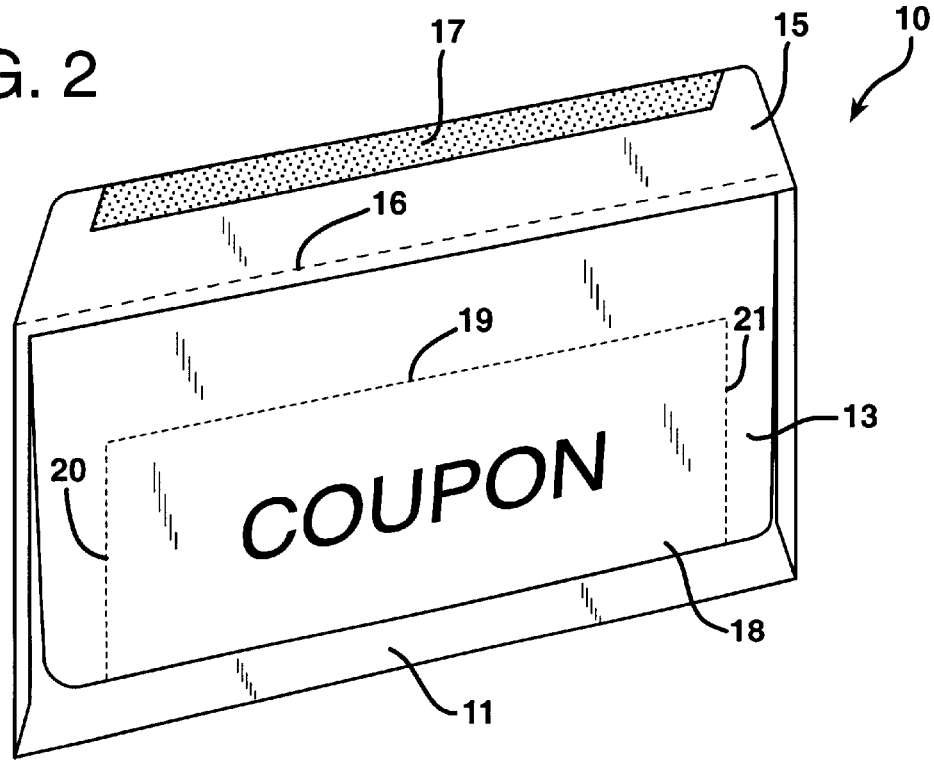
FIG. 2 is a view similar to FIG. 1 showing the coupon bearing bangtail flap adhered to the rear panel of the envelope.
Figure 3:
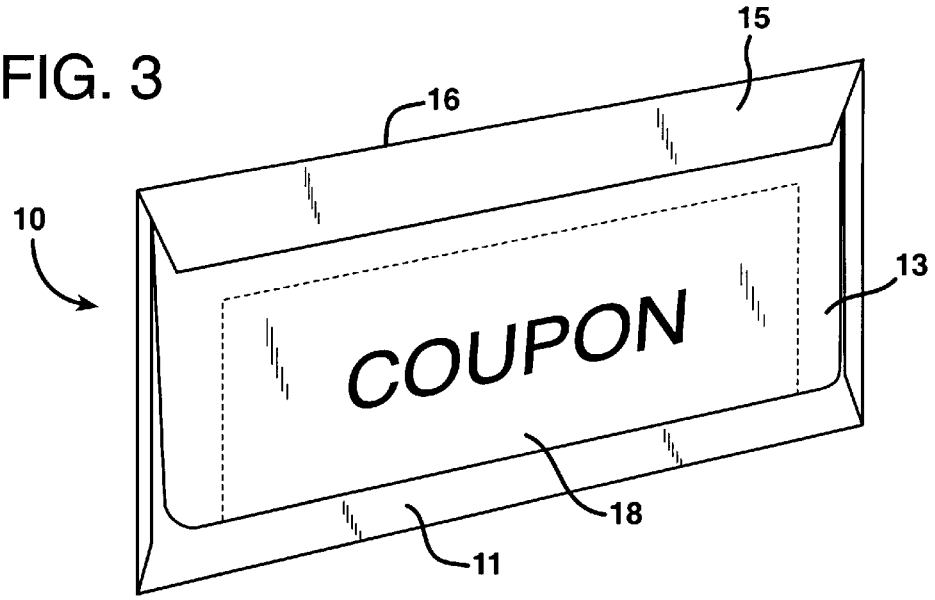
FIG. 3 is a view similar to FIG. 2 with the envelope closed.
Figure 4:
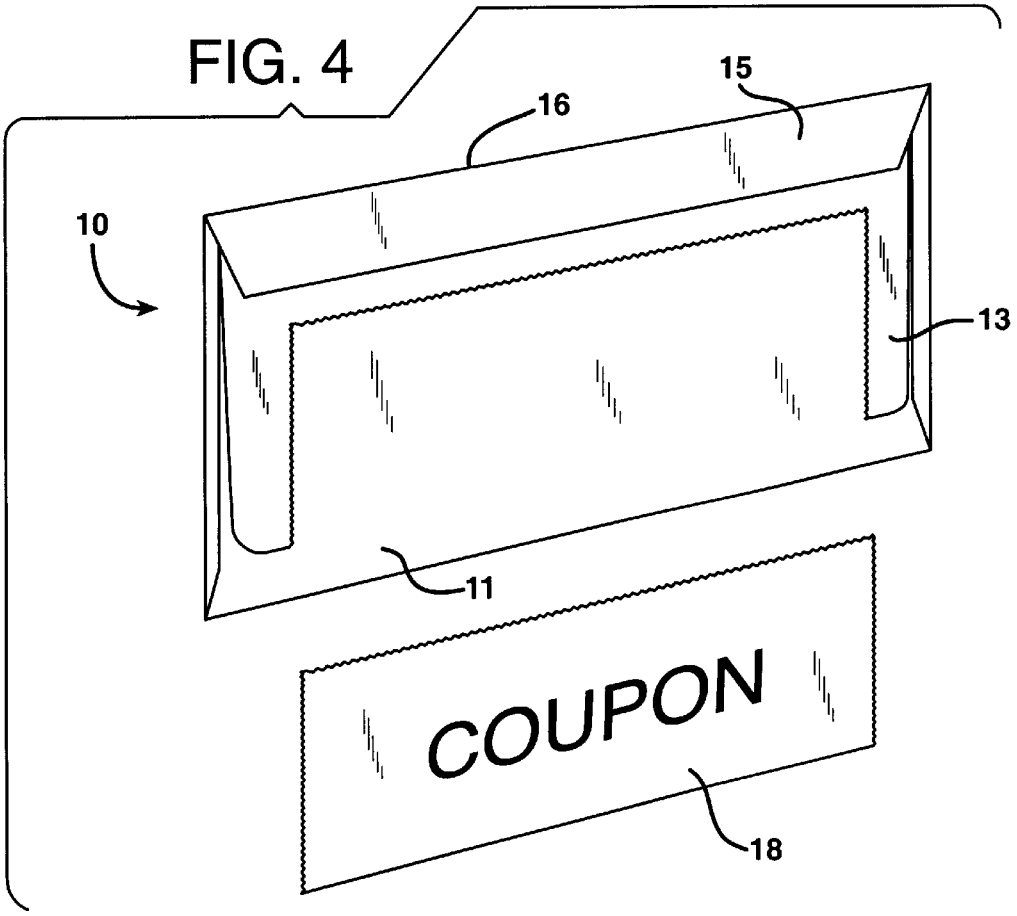
FIG. 4 is a view similar to FIG. 3 with the coupon portion of the bangtail flap removed; and, FIG. 5 is a view similar to FIG. 1 showing an alternative construction.

Referring now to the drawings, the envelope shown generally as 10 comprises an envelope body including rear panel 11, and a front panel and side closure flaps (not shown), which together define an open throat portion 12. The envelope structure further comprises an inner bangtail flap 13, foldably attached to the rear panel 11 along a score line 14, and an outer closure flap 15 foldably attached to the envelope front panel along a score line 16. Closure flap 15 further includes a line of adhesive 17 for closing the envelope after filling.

Figure 5:
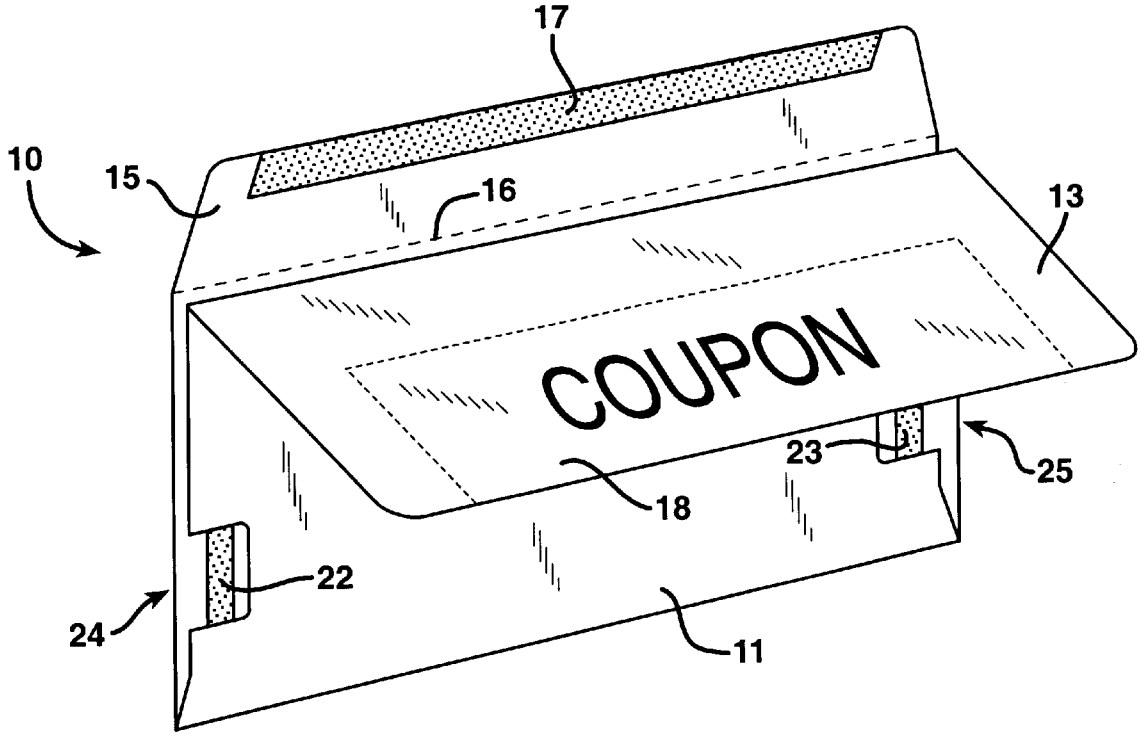

Meanwhile, the inner bangtail flap 13 bears a coupon portion 18 detachable therefrom along perforated lines 19, 20 and 21, and a means, illustrated for example by adhesive strips 22, 23 applied to rear panel 11, for adhering the outer edges of the bangtail flap 13 to the outer edges of the rear panel 11. It will be understood in this regard that the adhesive strips could just as readily be applied to the surface of the bangtail flap rather than to the surface of the rear panel, the objective being to make sure that only the outer edges of flap 13 are adhered so that the coupon element 18 is readily available. Further it will be understood, particularly as shown in FIG. 5, that the side edges of the bangtail flap 13 may be adhered directly to the envelope structure side closure flaps by providing cut outs or the like 24, 25 in the side edges of the rear panel 11. Other alternatives for achieving this purpose will be obvious to those skilled in the art.

When constructed as described above, the envelope may be formed and filled with conventional envelope folding and forming equipment since the bangtail flap is held down during processing and does not interfere with the mechanical equipment. Yet, the envelope so formed provides ready access to the coupon element without actually opening the envelope.

While only a single embodiment has been fully described herein, it will be understood that modifications and changes made be made by those skilled in the art within the scope of the appended claims.

What is claimed is:

1. A coupon bearing envelope comprising an envelope body having an open throat portion formed between a front panel and a rear panel, said front and rear panels being connected together at their bottom edges and having substantially coextensive top edges and opposed side edges that are connected together by side closure flaps;

a bangtail flap having a length and height that is substantially coextensive with the length and height of said rear panel; and a closure flap having a length that is substantially the same as the length of said bangtail flap and a height that is substantially less than the height of said bangtail flap;

wherein said bangtail flap is foldably attached to the top edge of said rear panel along a first foldable attachment, and folded over about said first foldable attachment so as to lie exteriorly of and adjacent to said rear panel, and said closure flap is foldably attached to the top edge of said front panel along a second foldable attachment, and folded over about said second foldable attachment so as to partially overlap said bangtail flap and close the throat portion of said envelope body;

and further wherein the two opposed side edges of said bangtail flap are adhered to the opposed side edges of said envelope body, and a detachable coupon element is formed in said bangtail flap in the region between the adhered side edges thereof and the region not overlapped by said closure flap.

2. The coupon bearing envelope of claim 1, wherein each side closure flap includes an adhesive strip for adhering the front panel to the rear panel.

3. The coupon bearing envelope of claim 2, wherein each of the opposed side edges of the rear panel includes one or more cutouts to expose at least a portion of the adhesive strip of the side closure flap for adhesion of one side edge of the bangtail flap.

4. The coupon bearing envelope of claim 3, wherein each of the opposed side edges of the rear panel includes a single cut out.

* * * * *